US010398243B2

(12) United States Patent
Sedgwick

(10) Patent No.: US 10,398,243 B2
(45) Date of Patent: Sep. 3, 2019

(54) STACKABLE FOOD HOLDER

(71) Applicant: Inno-Pak, LLC, Delaware, OH (US)

(72) Inventor: Nathan Sedgwick, Aliso Viejo, CA (US)

(73) Assignee: Inno-Pak, LLC, Delaware, OH (US)

( * ) Notice: Subject to any disclaimer, the term of this patent is extended or adjusted under 35 U.S.C. 154(b) by 7 days.

(21) Appl. No.: 15/786,555

(22) Filed: Oct. 17, 2017

(65) Prior Publication Data

US 2019/0053652 A1 Feb. 21, 2019

Related U.S. Application Data

(60) Provisional application No. 62/547,991, filed on Aug. 21, 2017.

(51) Int. Cl.
*A47G 19/30* (2006.01)

(52) U.S. Cl.
CPC ..... *A47G 19/30* (2013.01); *A47G 2019/306* (2013.01)

(58) Field of Classification Search
CPC .. A47G 19/30; A47G 2019/306; A47G 23/06; A47G 21/001; A47F 7/0071; A47F 7/0028; A47F 7/0057; B65D 5/5293; B65D 25/10; B65D 71/72; B65D 1/36; B65D 71/10; B65D 5/5038; B65D 81/133; B65D 1/40; B65D 1/42; B65D 1/44; B65D 1/46; B65D 1/48; B65D 25/103; B65D 25/107; B65D 5/04; B65D 5/5052; B65D 71/70; A21D 13/42; Y10S 229/904; Y10S 229/938; A47J 47/14
USPC ..... D7/504, 546, 631; 211/85.4, 73, 72; 229/904, 938, 407, 120.12–120.18, 902; 206/564, 557, 204, 518, 587, 203, 505; 220/23.8, 507, 574.1, 574, 608; D6/682.4; 426/112, 115, 119, 394, 395; 248/346.01, 346.03, 346.4
See application file for complete search history.

(56) References Cited

U.S. PATENT DOCUMENTS 2,814,381 A * 11/1957 Stevick ..... B65D 81/262 220/324
2,823,797 A * 2/1958 Amatel ..... B65D 5/5007 206/419
3,084,790 A * 4/1963 Lugt, Jr. ..... B65D 5/4802 206/562
3,101,166 A * 8/1963 Van Antwerpen ..... B65D 5/504 206/454
3,128,030 A * 4/1964 Davies ..... B65D 75/22 206/557
3,212,907 A * 10/1965 Caprioli ..... B65D 1/36 229/406
3,362,609 A * 1/1968 Freedy ..... B65D 5/504 206/454
3,372,812 A * 3/1968 Parcels ..... A47F 7/0057 206/445
3,559,866 A * 2/1971 Olson, Sr. ..... B65D 5/504 206/454

(Continued)

*Primary Examiner* — Hiwot E Tefera
(74) *Attorney, Agent, or Firm* — Ward and Smith, P.A.; Ryan K. Simmons

(57) ABSTRACT

A stackable food holder is disclosed. The food holder includes a first and second inclined sidewall separated by a mostly flat base portion. The inclined sidewalls include a plurality of channels configured to dissipate heat and humidity from the food item.

6 Claims, 8 Drawing Sheets

(56) References Cited

U.S. PATENT DOCUMENTS 3,591,032 A * 7/1971 Baxter ..... B65D 1/36 108/53.1
3,610,512 A * 10/1971 Hermalin ..... A47G 21/001 229/117
D246,491 S * 11/1977 D'Alo ..... D6/682.4
4,101,049 A * 7/1978 Wallace ..... B65D 21/045 206/507
4,195,732 A * 4/1980 Bell ..... B65D 19/44 206/386
D263,191 S * 3/1982 Moore ..... D19/90
4,369,913 A * 1/1983 Muise ..... B65D 5/0035 206/509
4,832,199 A * 5/1989 Rigby ..... B65D 5/5021 206/485
5,058,744 A * 10/1991 Creaden ..... B65D 85/42 206/419
D334,867 S * 4/1993 May ..... D7/504
5,310,977 A * 5/1994 Stenkamp ..... B65D 81/264 219/727
D385,080 S * 10/1997 Schueneman ..... D34/38
5,884,783 A * 3/1999 Proulx ..... A47G 19/30 211/70.1
6,142,440 A * 11/2000 Gratz ..... A47F 7/17 108/51.11
6,269,961 B1 * 8/2001 Porcelli ..... A47F 5/112 211/70.7
6,273,278 B1 * 8/2001 Enyedy ..... A47F 7/0028 211/73
6,474,613 B2 * 11/2002 O'Malley ..... B65D 19/44 248/346.02
2008/0286431 A1 * 11/2008 Brown ..... A47G 19/30 426/560
2010/0112292 A1 * 5/2010 Gilfert ..... B65D 57/00 428/156
2011/0094918 A1 * 4/2011 Hernandez ..... B65D 21/0223 206/521.15
2011/0120993 A1 * 5/2011 Birchmeier ..... B65D 1/36 219/729
2013/0134067 A1 * 5/2013 Ramirez ..... B65D 1/36 206/562
2017/0295974 A1 * 10/2017 Lai ..... A47G 23/06

* cited by examiner

STACKABLE FOOD HOLDER

CROSS-REFERENCE TO RELATED APPLICATIONS

This application claims the benefit of U.S. Provisional Patent Application No. 62/547,991 filed on Aug. 21, 2017, which is incorporated by reference in its entirety in this disclosure.

TECHNICAL FIELD

This disclosure relates to food holders, and more particularly to stackable, disposable food holders.

BACKGROUND

The statements in this section merely provide background information related to the present disclosure and may not constitute prior art.

Restaurants, fast food businesses and other on-the-go food sellers generally serve food in various plastic and paper containers, packages, and trays. For some foods, the serving tray has been adapted specifically for the particular meal or snack. For example, nacho serving trays include an integral, divided area for keeping cheese or salsa separate from the nacho chips. For tacos, hot dogs and other like foodstuff, various holders are known in the art to keep the food upright until the food is picked up for consumption. In this way, food in the middle of the foodstuff remains in the center of the tortilla, wrap or hot dog bun instead of spilling outside.

These known taco holders are disadvantaged in that heat is not dissipated from an underside of the taco. Leaving the heated tortilla against a surface builds moisture within the tortilla from the heated taco filling and taco elements, such as heated beans, cheese, and vegetables, in some cases. Moisture compromises the integrity of the tortilla shell, i.e., the tortilla shell becomes soggy and susceptible to tearing when lifting to consume. When a compromised tortilla is lifted to be consumed, the tortilla can rip apart, spilling the taco filling and taco elements. FIG. 1 shows a known taco holder, which have smooth sides. These smooth sides do not enable venting of heated air or allow moisture to escape.

What is needed is a food holder that allows heated air to escape from the tortilla or breaded wrap before being absorbed in the tortilla.

SUMMARY

A food holder is disclosed. The food holder includes a first and second inclined sidewall separated by a mostly flat base portion. The inclined sidewalls include a plurality of channels configured to dissipate heat and humidity from the food item.

Certain embodiments include a perforation for dividing the holder into food dividers.

This summary is provided merely to introduce certain concepts and not to identify key or essential features of the claimed subject matter.

BRIEF DESCRIPTION OF THE DRAWINGS

One or more embodiments will now be described, by way of example, with reference to the accompanying drawings, in which.

DETAILED DESCRIPTION

Figure 1:
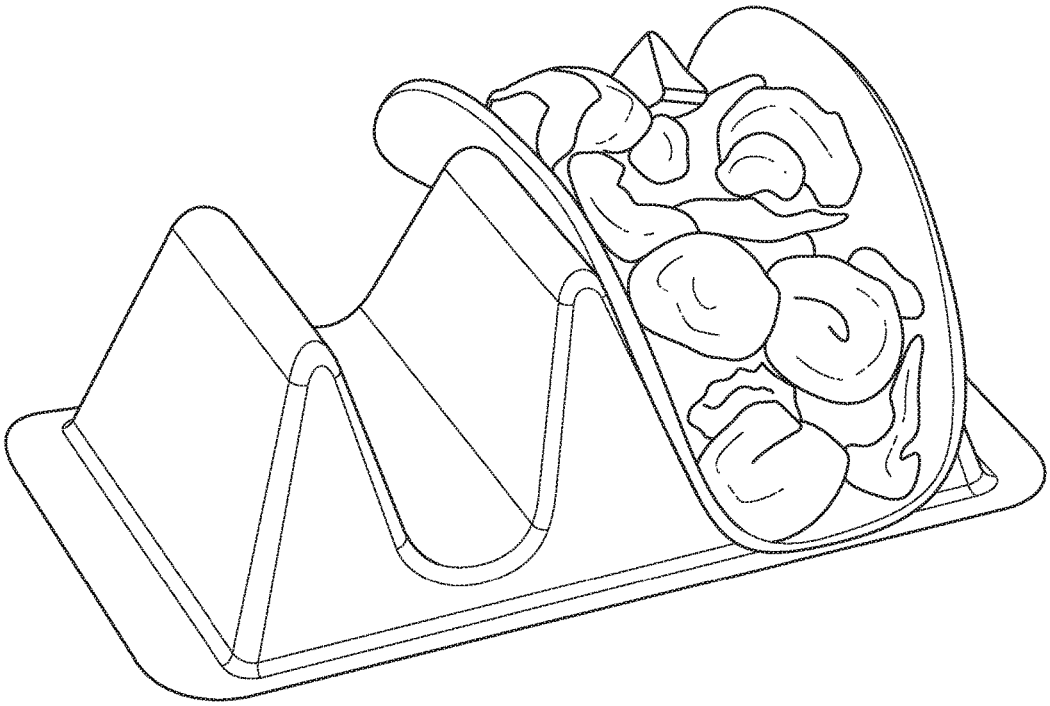
FIG. 1 (PRIOR ART)
FIG. 1 shows a prior art food holder.
Figure 2:
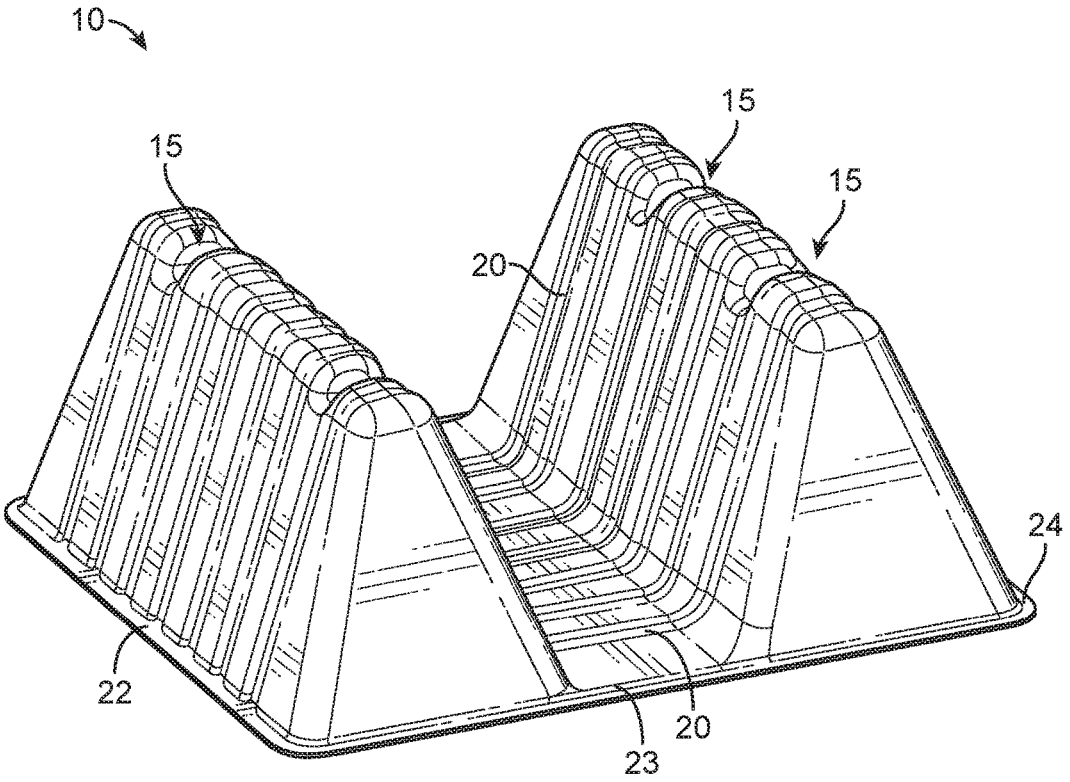
FIG. 2 shows a perspective view of an exemplary food holder, in accordance with the present disclosure.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" includes plural reference, and the meaning of "in" includes "in" and "on." The phrase "in one embodiment," as used herein does not necessarily refer to the same embodiment, although it may. Similarly, the phrase "in some embodiments," as used herein, when used multiple times, does not necessarily refer to the same embodiments, although it may. As used herein, the term "or" is an inclusive "or" operator, and is equivalent to the term "and/or," unless the context clearly dictates otherwise. The term "based, in part, on", "based, at least in part, on", or "based upon" is not exclusive and allows for being based on additional factors not described, unless the context clearly dictates otherwise.

Referring now to the drawings, wherein the depictions are for the purpose of illustrating certain exemplary embodiments only and not for the purpose of limiting the same, FIGS. 2-6 show an exemplary food holder 10. The food holder 10 is formed of a rigid or semi-rigid material, e.g., cardboard, paperboard-based materials, and pulp-based materials. In various embodiments, the food holder 10 may be formed of metal, plastic or any other food safe, polymer-based material sufficient to hold a taco or other like foodstuff in an upright manner.

Figure 3:
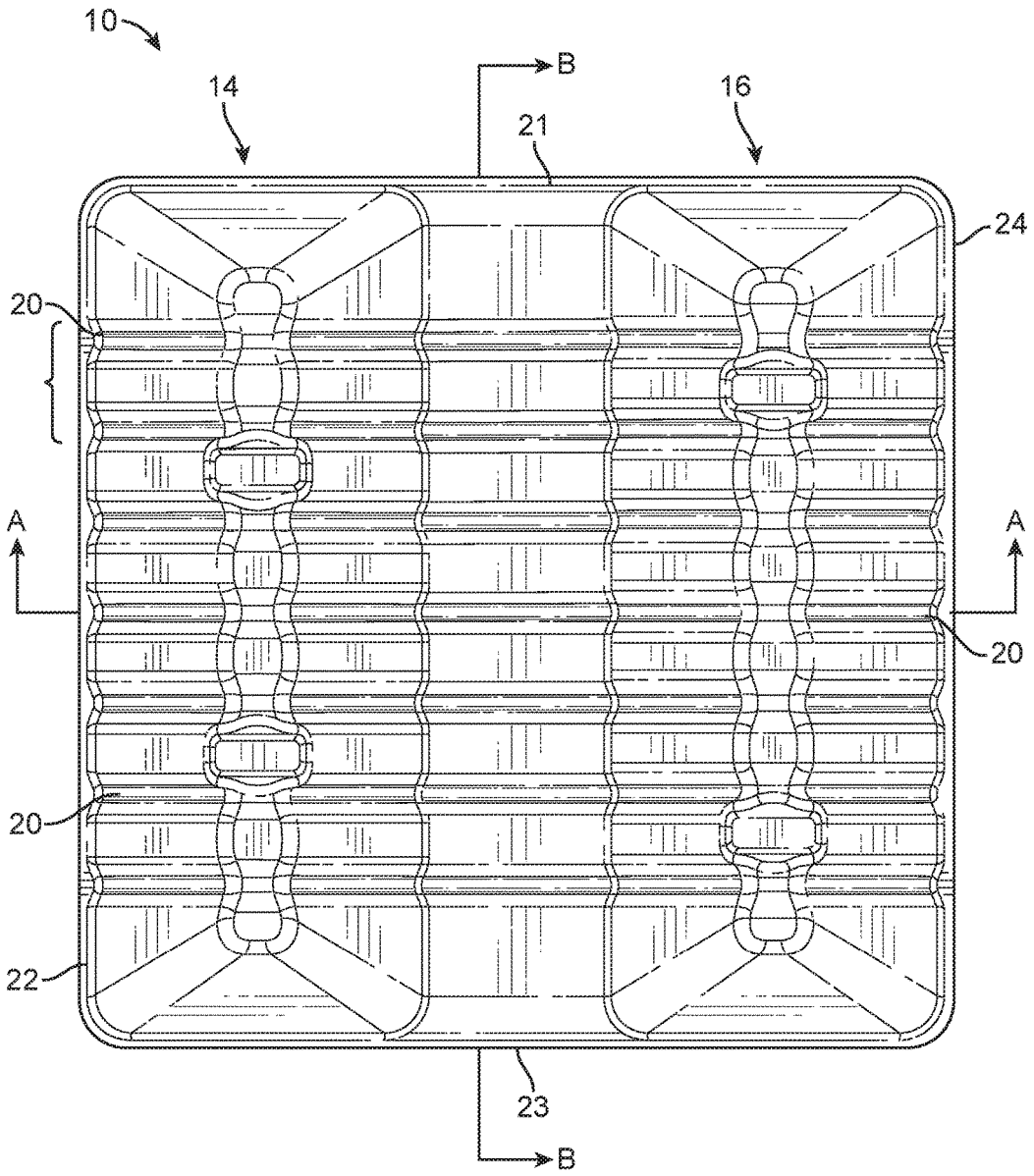
FIG. 3 shows a top view of the food holder, in accordance with the present disclosure.
Figure 4:
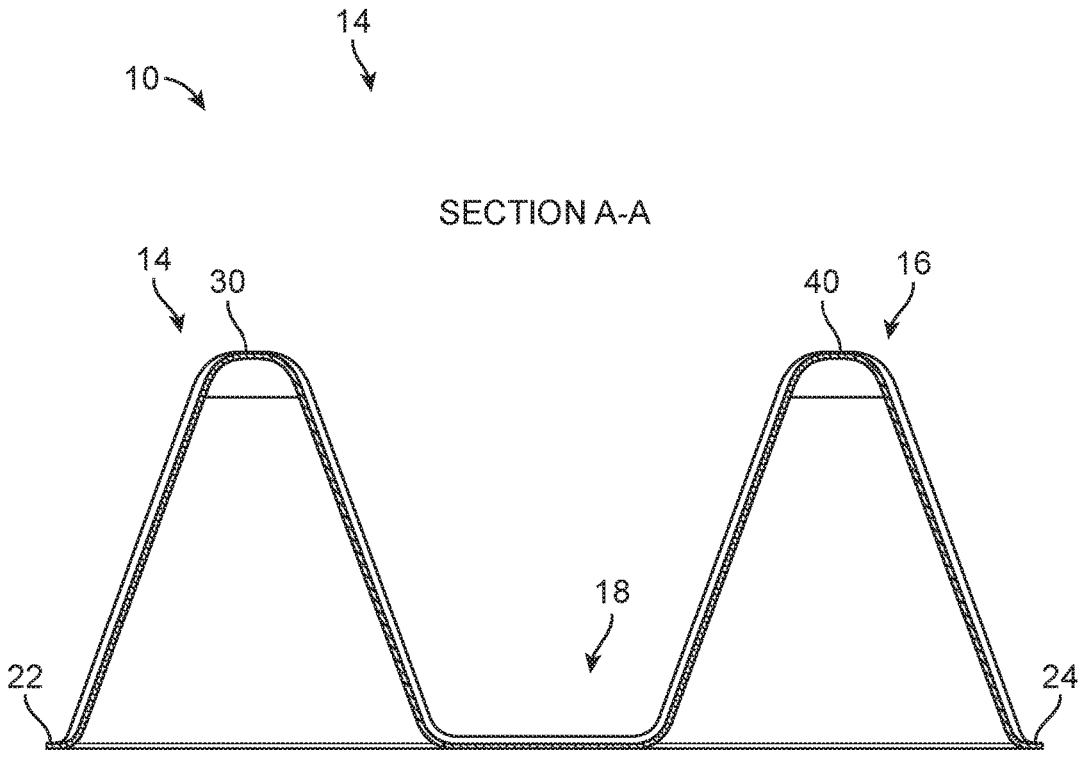
FIG. 4 shows a cross sectional view along line A-A of FIG. 3, in accordance with the present disclosure.
Figure 5:
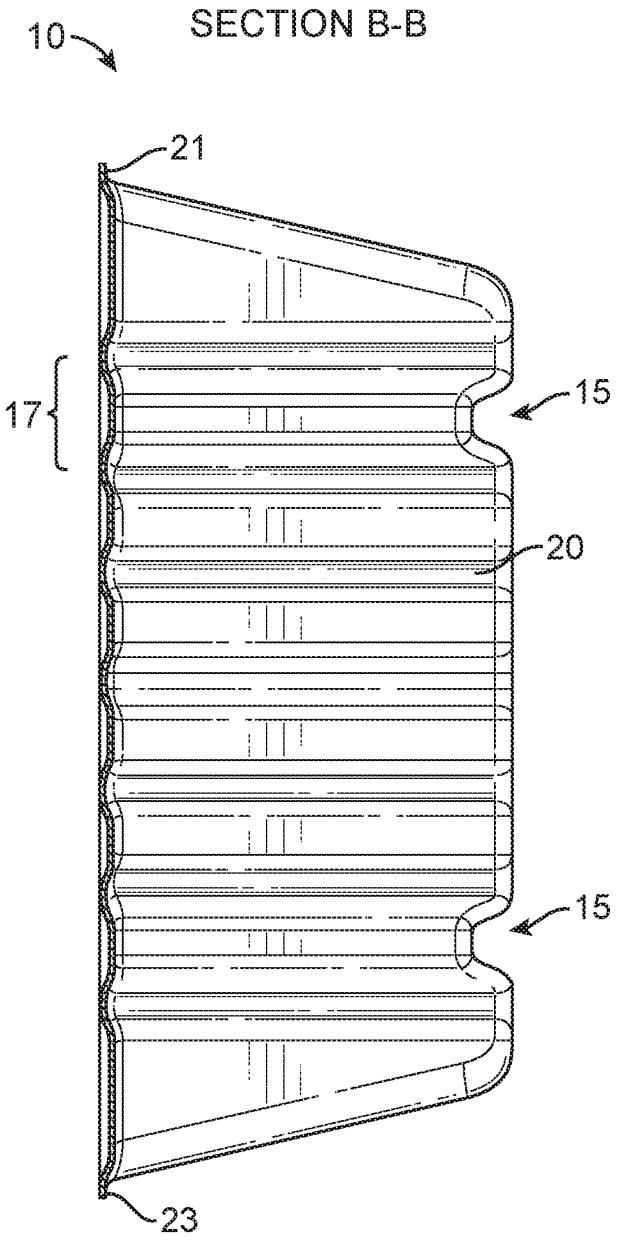
FIG. 5 shows a cross sectional view along line B-B of FIG. 3, in accordance with the present disclosure.

As FIGS. 2-6 show, the food holder 10 is configured to hold a taco or other like foodstuff in an upright position within a trough 12 defined by sidewalls 14 and 16, and a base 18. The sidewalls 14 and 16 are outwardly inclined, extending from the base 18 at a 70-degree angles as shown in FIG. 4. It is contemplated by the disclosure herein that the sidewalls may be inclined at many different angles. Preferably, however, the angles are within the range of: 40 to 80-degrees with respect to the axis X, as shown in FIG. 4.

Figure 7A:
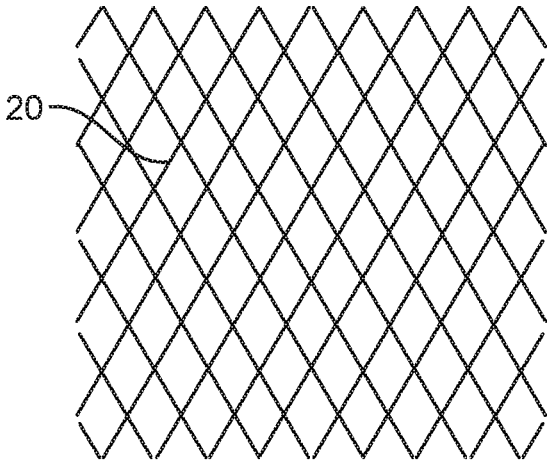
FIGS. 7A and 7B show alternative embodiments of channel arrangements, in accordance with the present disclosure.
Figure 7B:
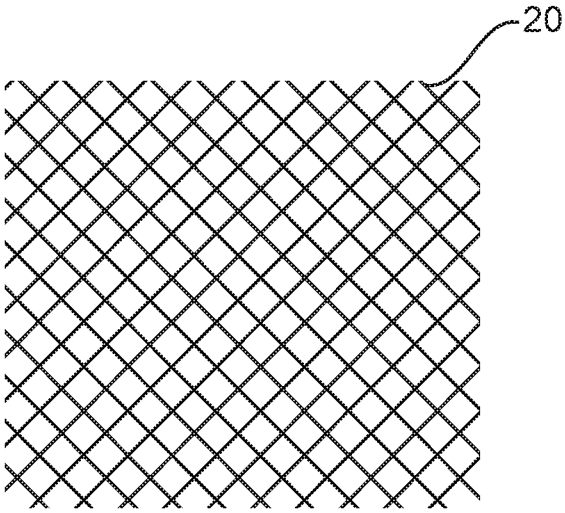

The base 18 and sidewalls 14 and 16 are formed with a plurality of channels 20. As shown, the channels 20 form a concave throughway at least from an apex 30 of the first sidewall 14 to an apex 40 of the second sidewall 16. In this way, the channels 20 form a void space between a surface of the sidewalls and the food stuff that dissipates heat and humidity from a foodstuff surface. In one embodiment, the throughway continues from a first side edge 22 of the food holder 10 to an opposing edge 24. In this way, the food holder 10 can mate in a stackable, i.e., nestable, fashion with other food holders. In other embodiments, the channels may be formed to incline at angles that are not perpendicular with an apex of the sidewalls. As FIGS. 7A and 7B show, the channels may be cross one another and/or configured to traverse up the sidewalls at the non-perpendicular manner. It is contemplated that the number, position, shape, size, and frequency of the channels with respect to the sidewalls may vary in further embodiments, and this disclosure herein is not intended to be limited to the perpendicular, concave-shape channels or the non-perpendicular crossing channels shown in the figures and discussed herein.

The sidewalls 14 and 16 preferably include one or more notches 15. The notches 15 of the first sidewall 14 may mirror notches in the second sidewall 16. In one embodiment, the notches 15 of the sidewalls may be alternating, or periodically alternating, with respect to segments 17 of a same sidewall. In one embodiment, the notches 15 may be alternating with respect to the opposing sidewall. For example, as shown in FIGS. 2-6, the notches 15 of sidewall 14 are not oppositely mirrored, but matched across with non-notched segments. In one embodiment, the notches 15 and non-notched segments of a sidewall are symmetrical with respect to a horizontal axis Y, such as shown in FIG. 3.

Segments 17, as used herein, are defined as a portion of the food holder 10 of a single sidewall extending from a mid-point of one channel to a mid-point of a second channel. The mid-point may be a low point within the channel 20. Each sidewall 14 and 16 preferably includes a plurality of segments 17. In one embodiment, the segments are sized and shaped for matching with undersides of segments from other food holders.

As shown, the base 18 is defined by a narrow longitudinal planar-shaped surface having a plurality of lateral, crossing channels 20 below a surface for engaging food. The base 18 terminates on the opening ends at edges 21 and 23 and at the beginning of the incline of the sidewalls 14 and 16. Edges 21, 22, 23, and 24 form a peripheral edge for support.

The base 18 preferably includes channels 20 linked to channels of the sidewalls 14 and 16. In various embodiments, the channels of the base 18 may be sized and shaped for longitudinal exit from the base 18, instead of the lateral exit as shown in the figures. As shown in the figures, the base 18 is substantially planar-shaped. It is contemplated herein that the base may be more curved in alternative embodiments, having a smooth transition from a bottom portion to the apex of the sidewalls.

Figure 6:
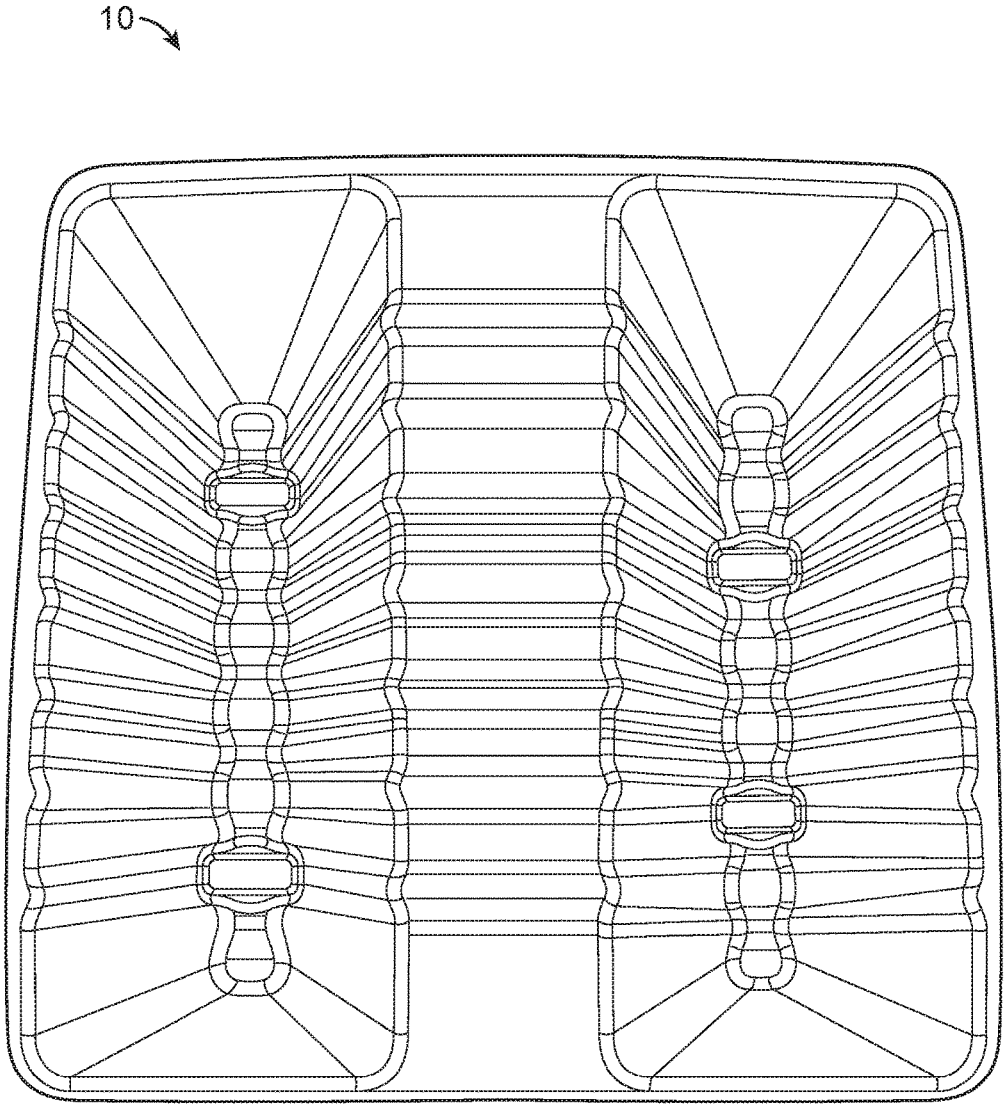
FIG. 6 shows a bottom perspective view of the food holder, in accordance with the present disclosure.

With specific reference to FIG. 6, as shown, a user may grasp an underside of the food holder 10 with their fingers and thumb. The food holder is formed, in one embodiment, of flexible material enabling the user to bend and flex the inner sidewalls against the food, thereby holding the food via the food holder 10. In this way, the user may grasp the food stuff while protecting their hand from often messy food.

In one embodiment, the entire food holder 10 is integrally formed of a substantially uniform thickness. In this way, the holders 10 may be stacked more economically for better storage and shipping.

In one embodiment, the food holder 10 may be perforated longitudinally through a middle of the base 18. In this way, the food holder 10 may be selectively separated into two separate sidewalls that may each function as a food divider. This feature may be helpful when a user desires to keep food separated in a bowl or dish. For example, the food divider may be useful for keeping rice separate from refried beans in a dish.

Figure 8A:
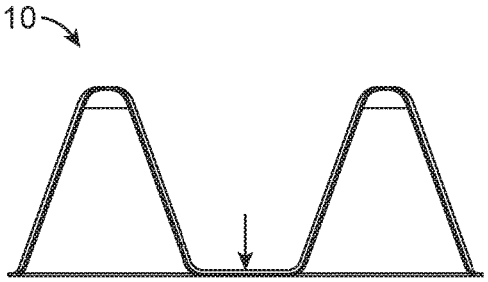
FIGS. 8A-8C show an exemplary function of the food holder, in accordance with the present disclosure.
Figure 8B:
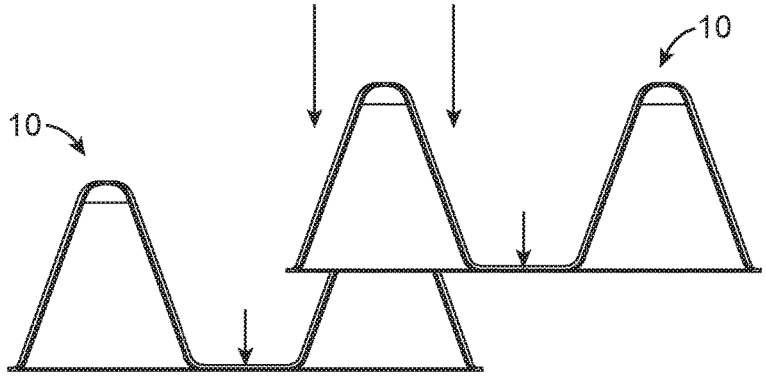
Figure 8C:
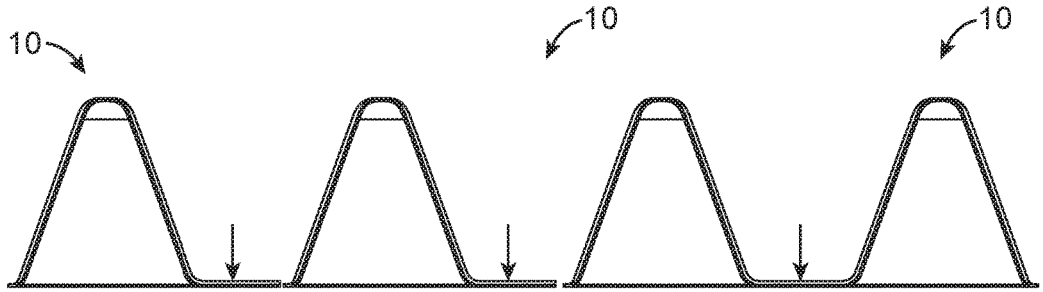

With specific reference to FIGS. 8A-8C, an exemplary function of the food holder 10 is illustrated. As FIGS. 8A-8C show, the food holder 10 may be stacked to accommodate multiple food holders 10 for holding multiple additional food items. Stacking food holders is accomplished by stacking half of a food holder over half of another food holder 10. As one skilled in the art will recognize, this technique may be applied to many additional food holders to arrive at any number of opening for more food items.

The disclosure has described certain preferred embodiments and modifications thereto. Further modifications and alterations may occur to others upon reading and understanding the specification. Therefore, it is intended that the disclosure not be limited to the particular embodiment(s) for carrying out this disclosure, but that the disclosure will include all embodiments falling within the scope of the appended claims.

The invention claimed is:

1. A stackable food holder for holding a food item in an upright position, the food holder comprising:

a peripheral edge;

a first portion having a mostly triangular-shaped cross section including a first inclined sidewall;

a second portion have a mostly triangular-shaped cross section including a second inclined sidewall;

a mostly flat base portion joining the first and second portions at the first and second inclined sidewalls, wherein the first and second inclined sidewalls are inclined outwardly from the base portion;

a plurality of channels configured to dissipate heat and humidity from the food item, the plurality of channels recessed from a surface of the first and second inclined sidewalls and the base portion; and wherein the first and second portions each include a rounded top having an undulating surface formed by the channels, wherein the undulating surface of the first portion includes a first notch configured to mate with an inner portion of a notch of another food holder to create an interference fit between multiple food holders, and wherein the second portion includes a second notch, and further wherein the first notch and the second notch are associated with a single channel of the plurality of channels, the single channel extending from the first notch of the first portion to the base portion to the second notch of the second portion.

2. The food holder of claim 1, wherein the first and second sidewalls are inclined within the range of: 40 to 80-degrees.

3. The food holder of claim 1, wherein the flat base portion includes a perforation extending between the first portion and the second portion.

4. The food holder of claim 1, wherein the channels have a semi-circular cross-sectional shape.

5. The food holder of claim 1, wherein the channels extend from a crest of the first portion to the base portion to a crest of the second portion.

6. The food holder of claim 1, wherein the flat base portion includes a perforation.

* * * * *